US011002065B2

(12) United States Patent
Balbach et al.

(10) Patent No.: US 11,002,065 B2
(45) Date of Patent: May 11, 2021

(54) SEALING SYSTEM FOR A CONDITIONED DOOR THRESHOLD

(71) Applicant: ASI Doors, Inc., Milwaukee, WI (US)

(72) Inventors: George F. Balbach, Lake Bluff, IL (US); Joseph M. Endter, Greendale, WI (US); Steven E. Spitz, New Berlin, WI (US); William B. Weishar, Brookfield, WI (US)

(73) Assignee: ASI Doors, Inc., Milwaukee, WI (US)

( * ) Notice: Subject to any disclaimer, the term of this patent is extended or adjusted under 35 U.S.C. 154(b) by 157 days.

(21) Appl. No.: 16/286,126

(22) Filed: Feb. 26, 2019

(65) Prior Publication Data

US 2019/0264496 A1 Aug. 29, 2019

Related U.S. Application Data

(60) Provisional application No. 62/635,291, filed on Feb. 26, 2018.

(51) Int. Cl.
*E06B 7/23* (2006.01)
*F25D 13/00* (2006.01)

(52) U.S. Cl.
CPC ..... *E06B 7/23* (2013.01); *E06B 7/2307* (2013.01); *E06B 7/2309* (2013.01); *E06B 7/2312* (2013.01); *E06B 7/2316* (2013.01); *F25D 13/00* (2013.01); *E05Y 2900/102* (2013.01)

(58) Field of Classification Search
None
See application file for complete search history.

(56) References Cited

U.S. PATENT DOCUMENTS 2,775,187 A 12/1956 McClurkin
3,341,974 A * 9/1967 Ganzinotti ..... F25D 23/082 49/477.1
4,009,586 A * 3/1977 Skvarenina ..... F25D 21/04 62/80
4,855,567 A 8/1989 Mueller
5,203,175 A 4/1993 Farrey et al.
5,329,781 A 7/1994 Farrey et al.
5,566,505 A * 10/1996 Kamezaki ..... E05D 15/1021 49/225
6,226,995 B1 5/2001 Kalempa et al.
6,983,565 B2 * 1/2006 Berry ..... E06B 3/80 49/118
7,578,097 B2 * 8/2009 Dondlinger ..... E06B 7/2318 49/118
8,429,929 B2 * 4/2013 Aragon ..... E06B 1/04 62/449

(Continued)

*Primary Examiner* — Catherine A Kelly
(74) *Attorney, Agent, or Firm* — Quarles & Brady LLP

(57) ABSTRACT

Embodiments of the invention provide a sealing system configured to provide a sealed boundary between a conditioned and an uncontrolled or separately conditioned environment. In some examples, the sealing system may comprise a door, a conditioning device, and a seal assembly. The door may be moveable between an opened position and a closed position. The seal assembly may be coupled to the door and have an airflow path. When the door is in the closed position, the conditioning device may be configured to direct conditioned air into the airflow path, thereby urging conditioned air through the seal to inhibit undesirable door and/or adjacent surface conditions.

18 Claims, 19 Drawing Sheets

(56) References Cited

U.S. PATENT DOCUMENTS

| | | | | |
|---|---|---|---|---|
| 8,752,335 | B2 * | 6/2014 | Hoffmann | E06B 7/2301 49/499.1 |
| 8,915,020 | B2 * | 12/2014 | Sauter | E06B 7/2318 49/477.1 |
| 9,429,353 | B2 * | 8/2016 | Schumacher | F25D 23/021 |
| 9,771,754 | B2 * | 9/2017 | Lewan | E06B 7/2309 |
| 10,760,331 | B2 * | 9/2020 | Mashburn | F16J 15/025 |
| 2010/0132264 | A1 | 6/2010 | Campbell et al. | |
| 2012/0085502 | A1 | 4/2012 | Berry et al. | |
| 2012/0260579 | A1 * | 10/2012 | DeMello | E06B 7/2314 49/477.1 |
| 2014/0259943 | A1 * | 9/2014 | Balbach | E06B 3/4636 49/404 |
| 2016/0029616 | A1 * | 2/2016 | Johnston | A01M 29/34 43/132.1 |
| 2019/0309551 | A1 * | 10/2019 | Hawkinson | E05D 15/0656 |

* cited by examiner

SEALING SYSTEM FOR A CONDITIONED DOOR THRESHOLD

RELATED APPLICATION

This application claims priority under 35 U.S.C. § 119 to U.S. Provisional Patent Application No. 62/635,291 filed on Feb. 26, 2018, entitled "Sealing System for a Conditioned Door Threshold," which is hereby incorporated by reference as if fully set forth herein.

BACKGROUND

The present disclosure is described in the context of sealing systems and methods. More specifically, the present disclosure relates to a sealing system for a sliding door configured to selectively seal and unseal a conditioned compartment.

Traditionally, sealing systems that are provided for selectively sealing and unsealing conditioned compartments (e.g., walk-in freezers) have some type of door movable between an opened position and a closed position. Given the conditions of the uncontrolled environment surrounding the door (e.g., temperature, humidity, etc.) frost can form and accumulate on an outer surface of the door and the surrounding surfaces, such as the floor. In some instances, this frost buildup can prevent the door from functioning properly or have other undesirable impacts on the working conditions near the door threshold.

SUMMARY

Some embodiments of the invention provide a sealing system configured to provide a sealed boundary between a first environment and a second environment. The sealing system comprises at least one door, a conditioning device, and a seal assembly. The door is moveable between an opened position and a closed position. The seal assembly is coupled to the door and defines an airflow path. When the door is in the closed position, the conditioning device is configured to direct conditioned air into the airflow path, thereby urging conditioned air through the airflow path to inhibit undesirable door and/or adjacent surface conditions.

Other embodiments of the invention provide a sealing system configured to provide a sealed boundary between a first environment and a second environment. The sealing system comprises a pair of doors and a conditioning device. The pair of doors is moveable between an opened position and a closed position. Each door of the pair of doors has a seal assembly coupled thereto and defining an airflow path. When the pair of doors is in the closed position, the conditioning device is configured to direct conditioned air through the airflow paths of the pair of doors, thereby urging conditioned air through the airflow paths to inhibit undesirable door and adjacent surface conditions.

Further embodiments of the invention provide a seal assembly configured for use with a door having a leading end, an upper end, a trailing end, a lower end, and an inner door surface. The seal assembly comprises a bumper seal configured to couple to and extend along the leading end of the door, a lower seal configured to couple to and extend along the lower end of the door, and a peripheral seal configured to couple to the inner door surface of the door and extend along each of the leading end, the upper end, and the trailing end of the door. The bumper seal, the lower seal, and the peripheral seal are configured to collectively form an airflow path when coupled to the door.

BRIEF DESCRIPTION OF THE DRAWINGS

FIG. 9 is a detail, isometric view of a leading lower corner of the sliding door of

FIG. 4.

DETAILED DESCRIPTION

Figure 1:
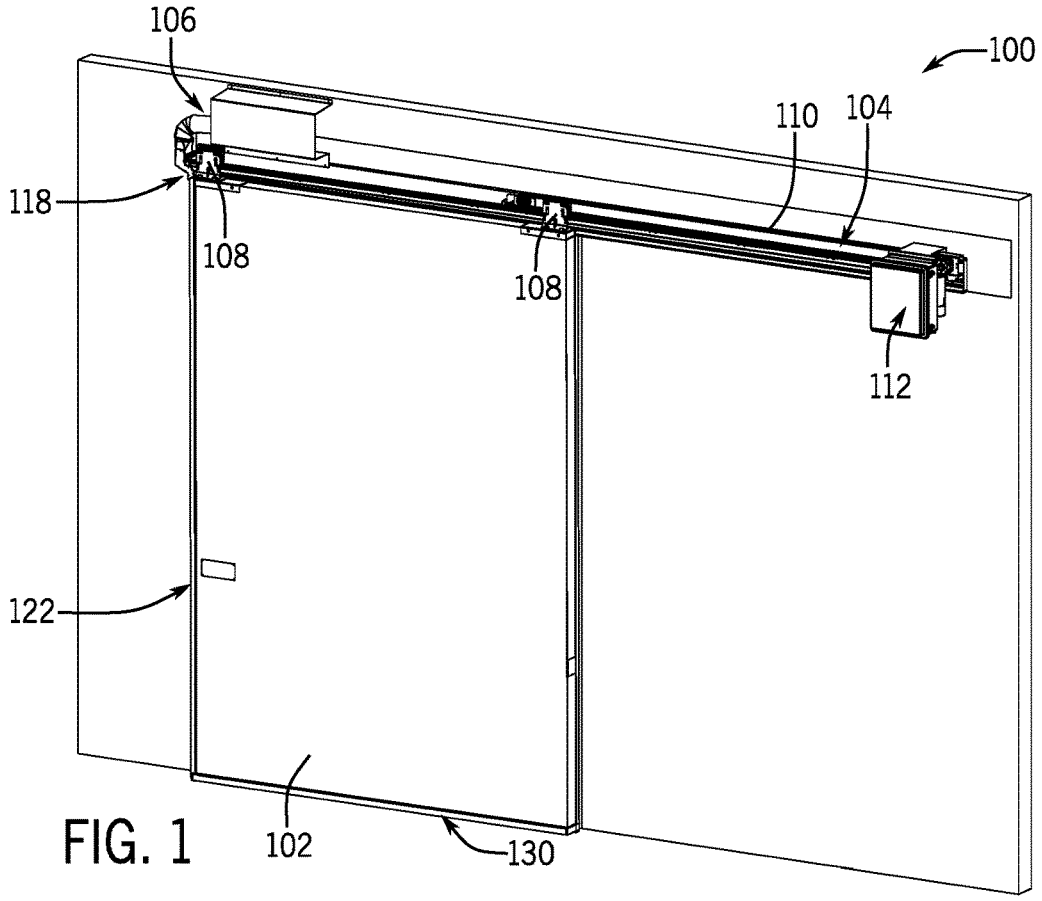
FIG. 1 is a front, top, right, isometric view of an example sealing system in accordance with the disclosure, shown in a closed position.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Given the benefit of this disclosure, modifications to the illustrated embodiments will become apparent to those skilled in the art, and the fundamental principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Figure 2:
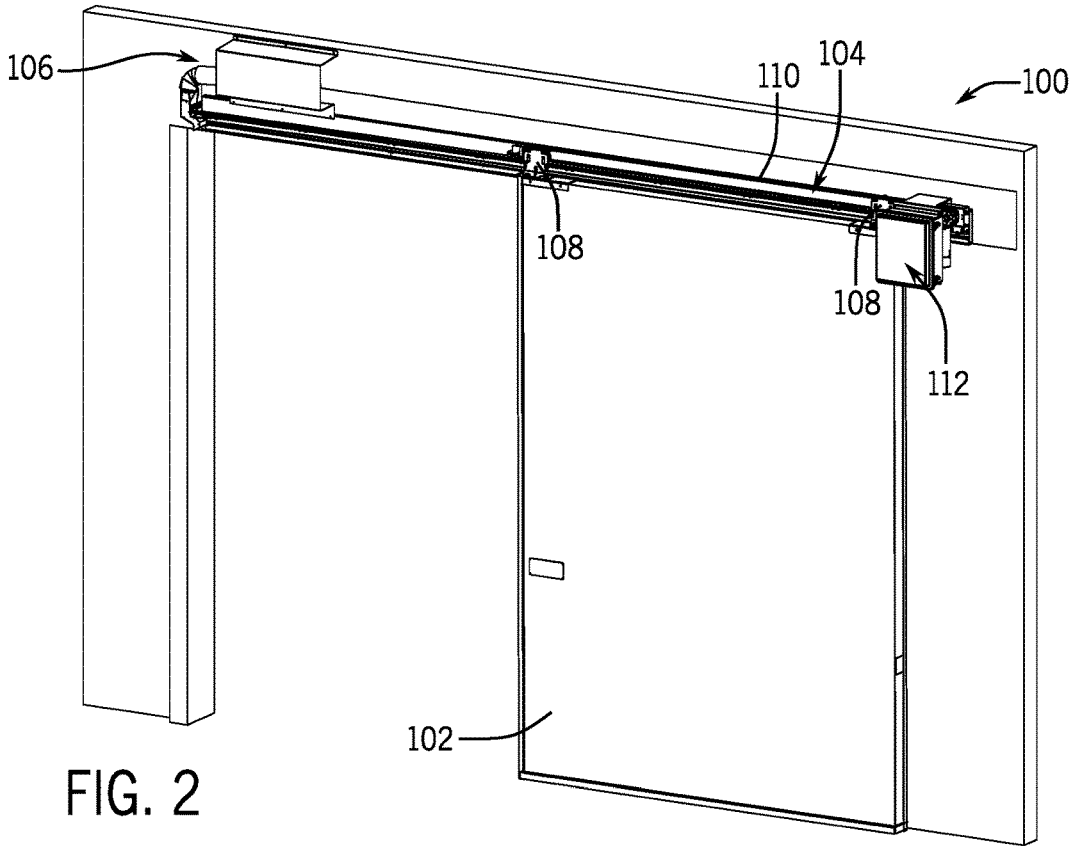
FIG. 2 is a front, top, right, isometric view of the sealing system of FIG. 1, shown in an opened position.

FIGS. 1 and 2 show an exemplary sealing system 100 in accordance with the disclosure. The sealing system 100 is configured to provide a sealed threshold between a conditioned space, such as a walk-in freezer compartment, and an uncontrolled or alternatively conditioned environment (e.g., a loading dock or warehouse), while preventing frost build-up around a door and nearby surfaces (e.g., the floor near the door). As illustrated, the sealing system 100 comprises a sealing door 102, a sliding door track 104, and a conditioning device (e.g., a heating device 106). While the example conditioning device is shown in the form of a forced air heater, the conditioning device may include other conditioning devices, such as desiccant units or dehumidifiers, which may include actively altering the temperature or other properties of the air. The sealing door 102 is slidably coupled to the sliding door track 104 by track-engaging roller carriages 108. The sealing door 102 is movable between a closed position (shown in FIG. 1) and an opened position (shown in FIG. 2). In some instances, the sliding door track 104 may include an actuation belt 110 in communication with a power supply 112 and associated motor(s), controller(s), and related control sensors (e.g., limit switches, motor-encoded position sensors, etc.). The actuation belt 110 may be coupled to at least one of the track-engaging roller carriages 108. As such, the sealing door 102 may be movable between the closed position and the opened position through the use of a switch, an autonomous sensor (e.g., motion sensor, pneumatic sensor, capacitive sensor, etc.), or any suitable selective actuation mechanism.

Figure 3:
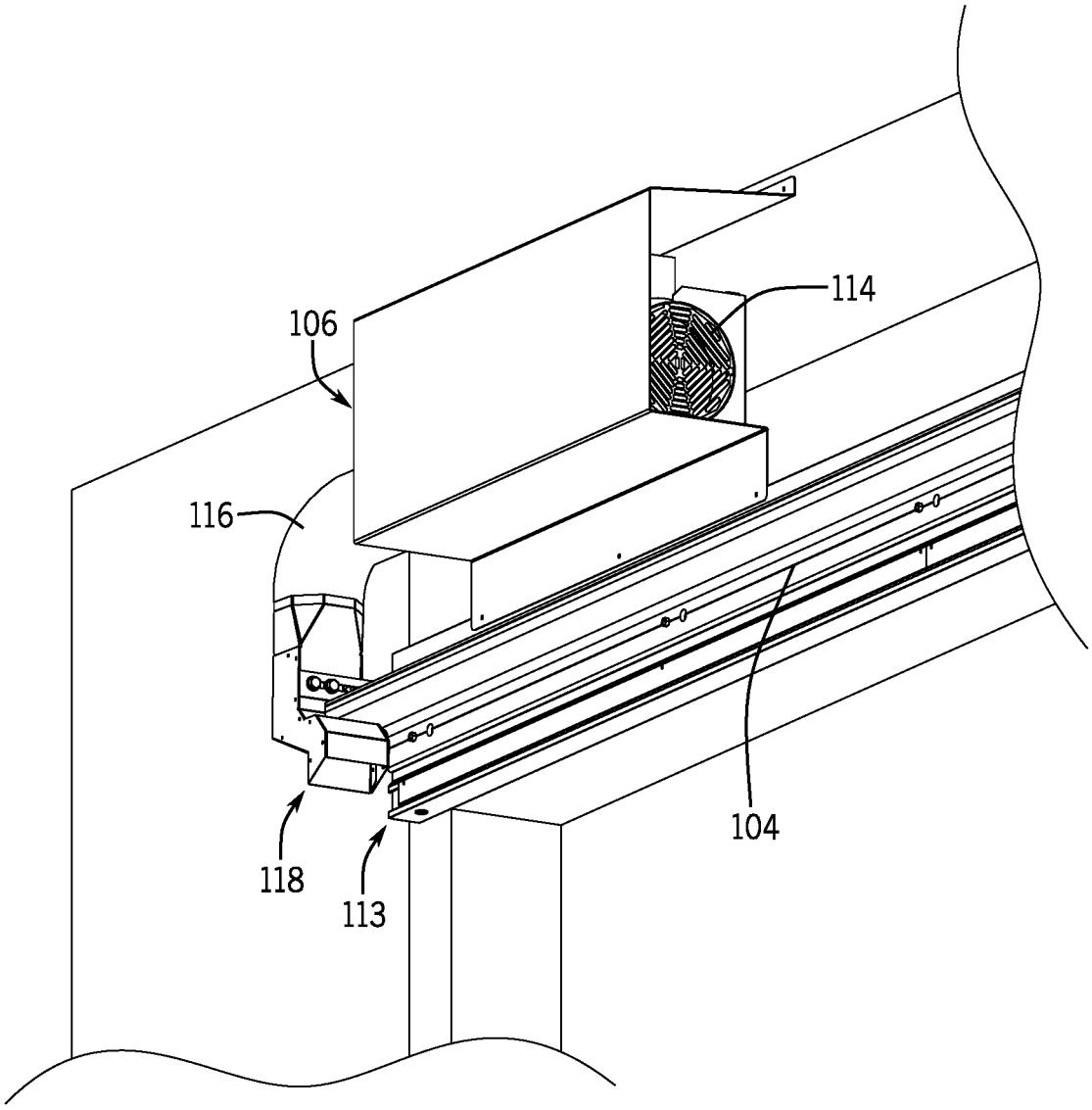
FIG. 3 is a front, bottom, right, isometric view of a heating device of the sealing system of FIG. 1.

Referring to FIG. 3, the example heating device 106 is disposed proximate a first end 113 of the sliding door track 104. The heating device 106 includes a heating element (not shown), a fan motor 114, a fan conduit 116, and an outlet section 118. The fan motor 114 is configured to blow air heated by the heating element, through the fan conduit 116, and out of the outlet section 118. The outlet section 118 is configured to fluidly engage the sealing door 102, as will be described below. In addition, while in one example the heating device 106 forces air out from the outlet section 118, alternative scenarios may call for air to be drawn into the "outlet" section 118.

Figure 4:
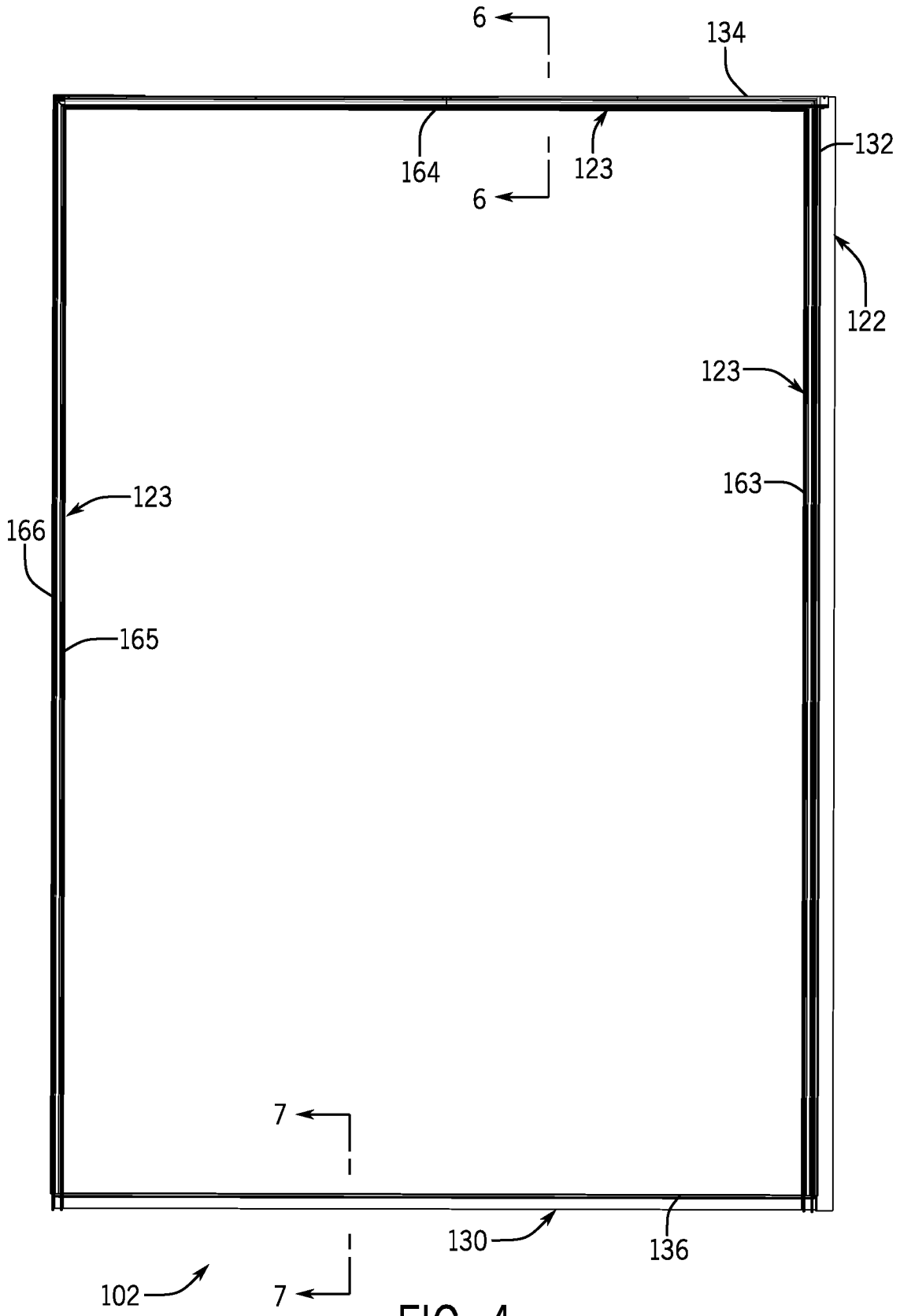
FIG. 4 is a rear elevational view of a sliding door of the sealing system of FIG. 1.

Referring now to FIG. 4, the sealing door 102 comprises a bumper seal 122, a peripheral seal 123, and a lower seal 130. The bumper seal 122 is coupled to a leading end 132 of the sealing door 102. The bumper seal 122 extends from an upper end 134 of the sealing door 102 to a lower end 136 of the sealing door 102. In some instances, the bumper seal 122 can be comprised of chlorosufonated polyethylene synthetic rubber, Hypalon®, urethane, extruded low temperature rubber, fabric, etc.

Figure 5:
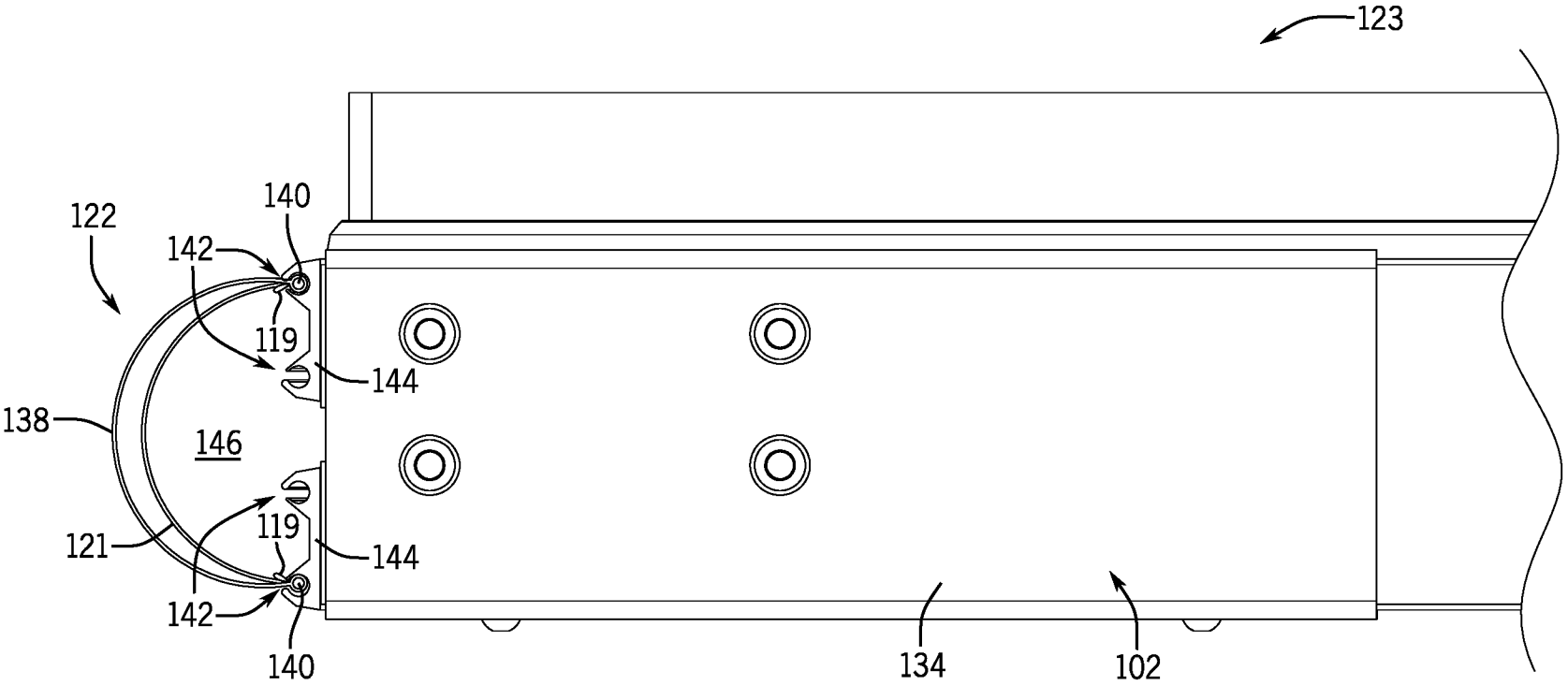
FIG. 5 is a detail view of a bumper seal of the sliding door of FIG. 4.

As shown in FIG. 5, the bumper seal 122 comprises a bumper portion 138 and end seams 140. The bumper portion 138 defines a generally arcuate shape extending between the end seams 140. In one embodiment, the end seams 140 are formed by doubling back an end of the bumper seal 122 over an elongated rod, such as a polyvinyl chloride rod, and sewing or otherwise bonding the rod in place. Residual material from the doubling back process further creates a pair of flap portions 119 that run the length of the bumper seal 122, which may be used to receive a series of flexible rectangular spacers 121, as will be discussed below. The end seams 140 are slidably received within selected seal channels 142 disposed on channel members 144. The channel members 144 extend from the upper end 134 of the sealing door 102 to the lower end 136 of the sealing door 102, and are coupled to the leading end 132 of the sealing door 102. In some instances, the channel members 144 can be adhered to the leading end 132 of the sealing door 102. In other instances, the channel members 144 can be coupled to the leading end 132 of the sealing door 102 using fasteners or any other suitable coupling mechanism. As such, the end seams 140 being slidably received within the seal channels 142 couples the bumper seal 122 to the sealing door 102 and further creates a bumper airflow pathway 146 between the bumper seal 122 and the sealing door 102. In some instances, the channel members 144 may not be included, and the bumper seal 122 may be alternatively coupled to the sealing door 102 using a long hook-and-loop fastener (e.g., Velcro®) running along the length of the leading end 132, as will be described below.

The series of flexible rectangular spacers 121 can be effectively slid or otherwise arranged between the pair of flap portions 119 and the bumper portion 138, thereby retaining the spacers 121 in contact with the bumper portion 138. As such, the series of flexible rectangular spacers 121 can be bent with the bumper portion 138 and engaged with the channel members 144 to help define and control the arcuate shape of the bumper portion 138 when the door 102 is in the closed and opened positions. The spacers 121 of the example embodiment are naturally flat rectangular thermoplastic sheets (e.g., two inches by seven inches with a nominal sheet thickness) that flex to an arcuate shape when engaged with the channel members 144. In one form the spacers 121 are spaced vertically about every eighteen inches, but other spacing may be used depending on application requirements. Alternatively, a single spacer may be incorporated that extends along a majority of the bumper portion 138.

Figure 6:
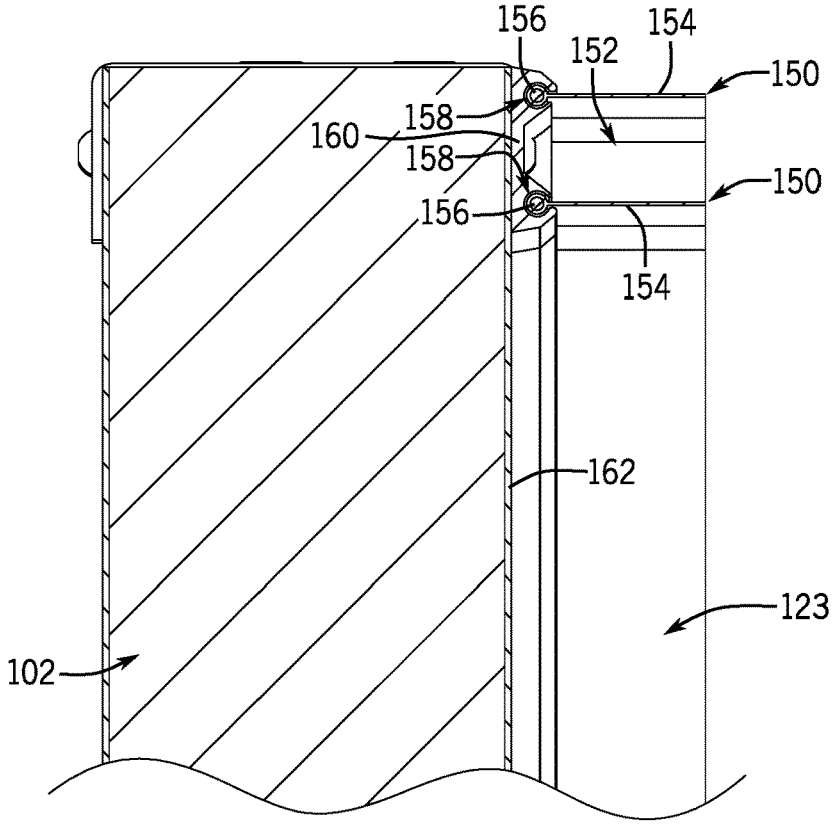
FIG. 6 is a partial cross-sectional view of the sliding door of FIG. 4, taken along line 6-6.

As shown in FIG. 6, the peripheral seal 123 comprises a pair of blade seals 150 defining a peripheral airflow pathway 152 therebetween. In some instances, the blade seals 150 can be comprised of chlorosufonated polyethylene synthetic rubber, Hypalon®, urethane, extruded low temperature rubber, fabric, etc. Each of the blade seals 150 includes a blade portion 154 and an end seam 156. Similar to the bumper seal 122, the end seams 156 of the blade seals 150 are slidably received within seal channels 158 disposed on channel members 160. The channel members 160 are coupled to an inner door surface 162 of the sealing door 102, thereby coupling the blade seals 150 to the inner door surface 162. In some instances, the channel members 160 can be adhered to the inner door surface 162 of the sealing door 102. In other instances, the channel members 160 can be coupled to the inner door surface 162 of the sealing door 102 using fasteners or any other suitable coupling mechanism. In some instances, the channel members 160 may not be included, and the blade seals 150 may be alternatively coupled to the sealing door 102 using a long hook-and-loop fastener (e.g., Velcro®) running along the periphery of the inner door surface 162, as will be described below.

Referring again to FIG. 4, the peripheral seal 123 includes a leading end portion 163, an upper portion 164, and a trailing end portion 165. The leading end portion 163 is disposed proximate the leading end 132 of the sealing door 102. The leading end portion 163 extends from the lower end 136 to the upper end 134 of the sealing door 102. The upper portion 164 is disposed proximate the upper end 134 of the sealing door 102 and extends from the top of the leading end portion 163 to a trailing end 166 of the sealing door 102. The trailing end portion 165 is disposed proximate the trailing end 166 of the sealing door 102 and extends from the end of the upper portion 164 that is proximate the trailing end 166 of the sealing door 102, downward, to the lower end 136 of the sealing door 102. The pair of blade seals 150, as described above, extend throughout each of the leading end portion 163, the upper portion 164, and the trailing end portion 165.

Figure 7:
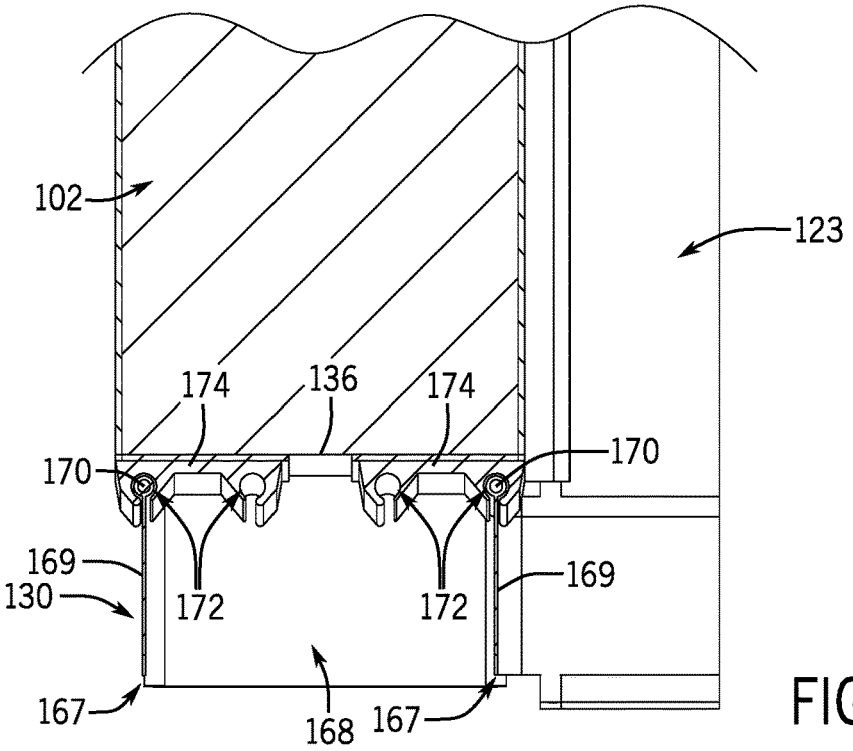
FIG. 7 is a cross-sectional view of the sliding door of FIG. 4, taken along line 7-7.

As shown in FIG. 7, the lower seal 130 similarly comprises a pair of blade seals 167 defining a lower airflow pathway 168 therebetween. The pair of blade seals 167 are substantially similar to the blade seals 150 described above. For example, each of the blade seals 167 similarly includes a blade portion 169 and an end seam 170. The end seams 170 are again slidably received within seal channels 172 disposed on channel members 174. The channel members 174 are coupled to the lower end 136 of the sealing door 102, thereby coupling the blade seals 167 to the lower end 136. In some instances, the channel members 174 can be adhered to the lower end 136 of the sealing door 102. In other instances, the channel members 174 can be coupled to the lower end 136 of the sealing door 102 using fasteners or any other suitable coupling device. Note that the various end seams (e.g., end seams 156, 170) of the peripheral seal 123 can be constructed similar to the end seams 140 of the bumper seal 122. In some instances, the channel members 174 may not be included, and the lower seal 130 may be alternatively coupled to the sealing door 102 using a long hook-and-loop fastener (e.g., Velcro®) running along the length of the lower end 136, as will be described below.

Figure 8:
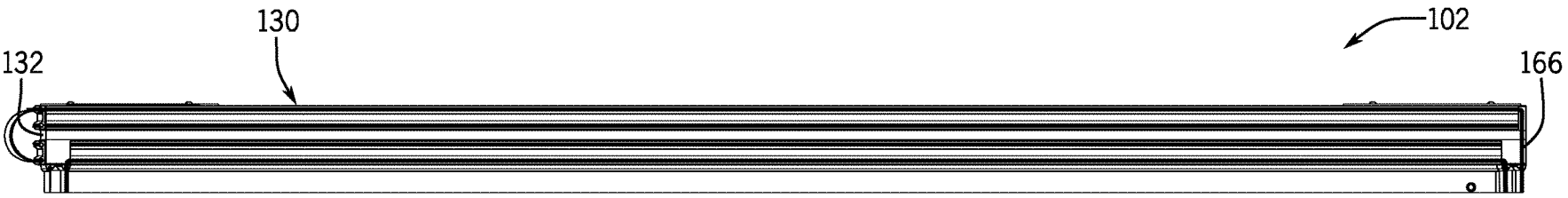
FIG. 8 is a bottom plan view of the sliding door of FIG. 4.
Figure 9:
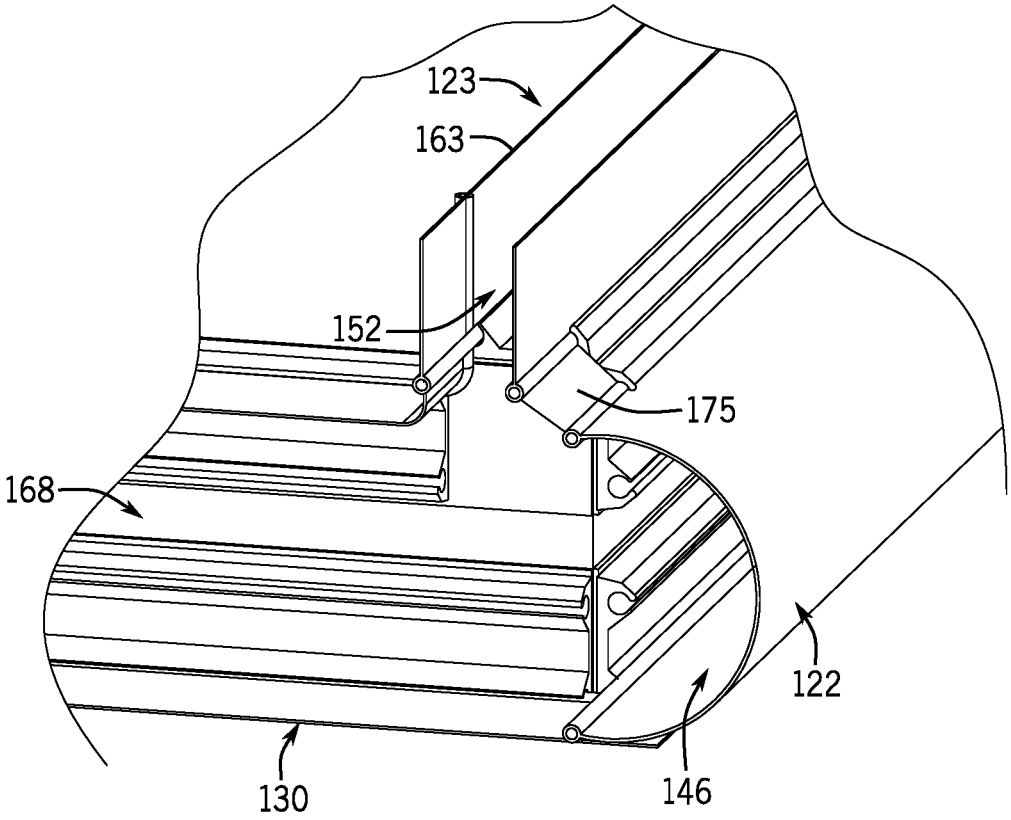
Figure 10:
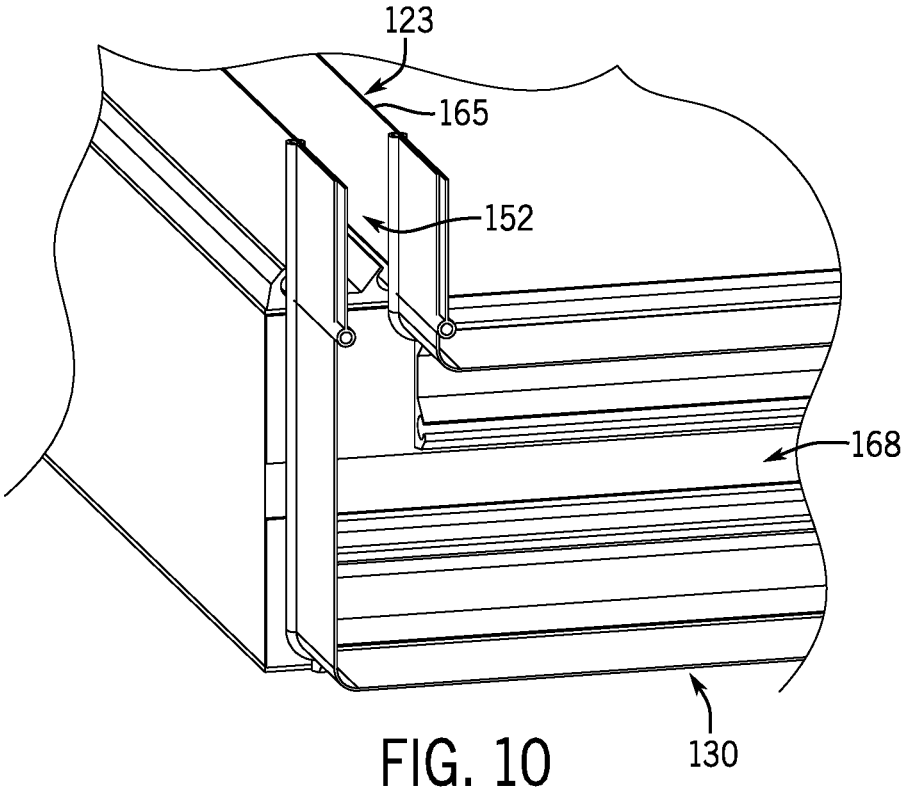
FIG. 10 is a detail, isometric view of a trailing lower corner of the sliding door of FIG. 4.

Referring now to FIGS. 8-10, the lower seal 130 extends from the leading end 132 to the trailing end 166 of the sealing door 102. As shown in FIG. 9, the lower seal 130 is coupled to both the leading end portion 163 of the peripheral seal 123 and the bumper seal 122. In the illustrated embodiment, a strip of material 175 is secured (e.g., adhered) between the bumper seal 122 and the peripheral seal 123 to prevent or reduce air leakage during operation. As shown in FIG. 10, the lower seal 130 is also coupled to the trailing end portion 165 of the peripheral seal 123. As such, the bumper airflow pathway 146 (shown in FIG. 9), the peripheral airflow pathway 152, and the lower airflow pathway 168 are all in fluid communication with each other.

Referring back to FIGS. 1 and 2, in some instances, during operation of the sealing system 100, the heating device 106 may be configured to continuously operate. That is, the heating device 106 may be configured to constantly blow conditioned air (e.g., heated air) out of the outlet section 118, regardless of the sealing door 102 being opened or closed. In other instances, the heating device 106 may be configured to selectively turn on and off based on the relative position of the sealing door 102, such as being opened or closed. For instance, the heating device 106 may be configured to turn on when the sealing door 102 is closed and to turn off when the sealing door 102 is opened. In either case, when the sealing door 102 is in the closed position, the outlet section 118 of the heating device 106 is aligned and engaged with the bumper seal 122, so that the heating device 106 directs heated air into the bumper airflow pathway 146. From the bumper airflow pathway 146, the heated air can flow into the lower airflow pathway 168 of the lower seal 130. It will be appreciated that the lower seal 130 engages or is near the ground during operation, thereby providing a seal for the lower airflow pathway 168, so that air flowing within the lower airflow pathway 168 does not excessively leak out into either of the freezer or the uncontrolled/alternatively conditioned environment surrounding the sealing system 100.

Figure 11:
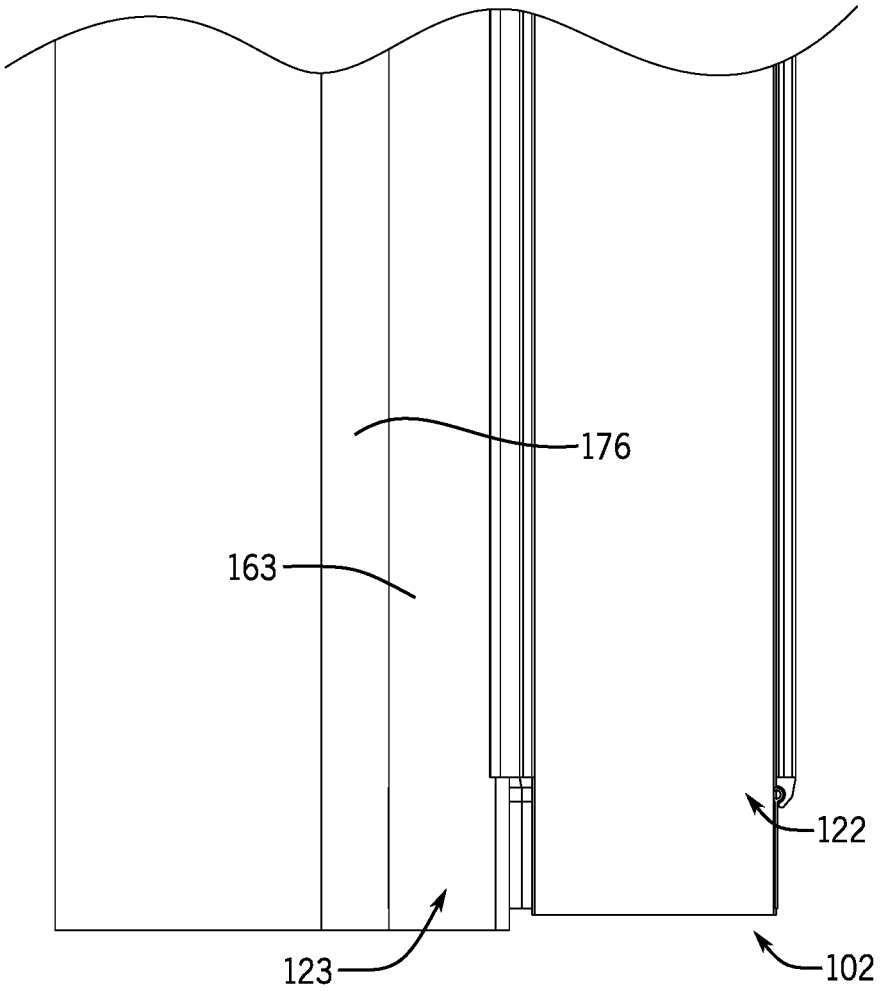
FIG. 11 is a detail view of a leading end portion of a peripheral seal of the sealing system of FIG. 1, shown engaged with a vertical door frame member.
Figure 12:
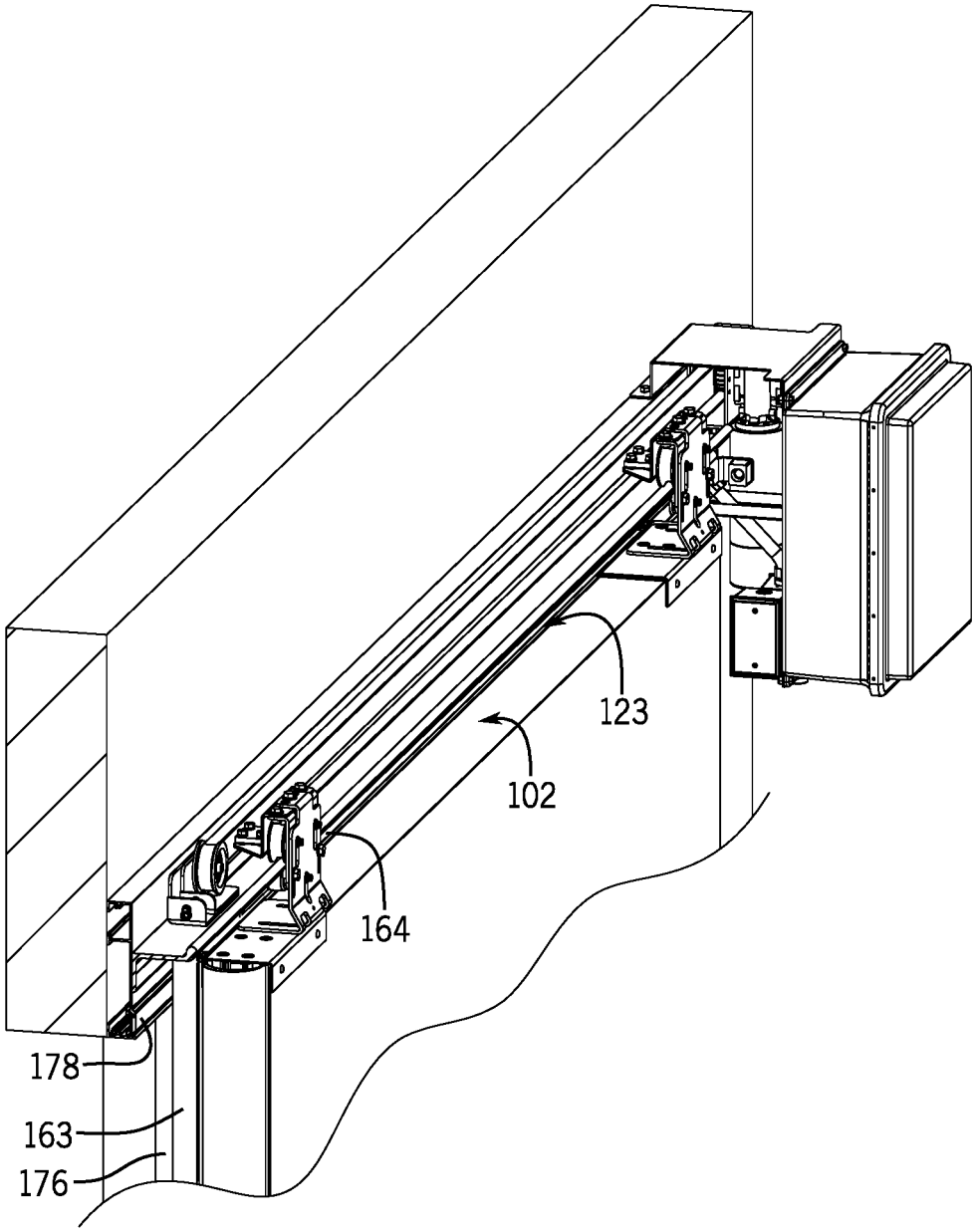
FIG. 12 is a detail view of an upper portion of a peripheral seal of the sealing system of FIG. 1, shown engaged with a horizontal door frame member.
Figure 13:
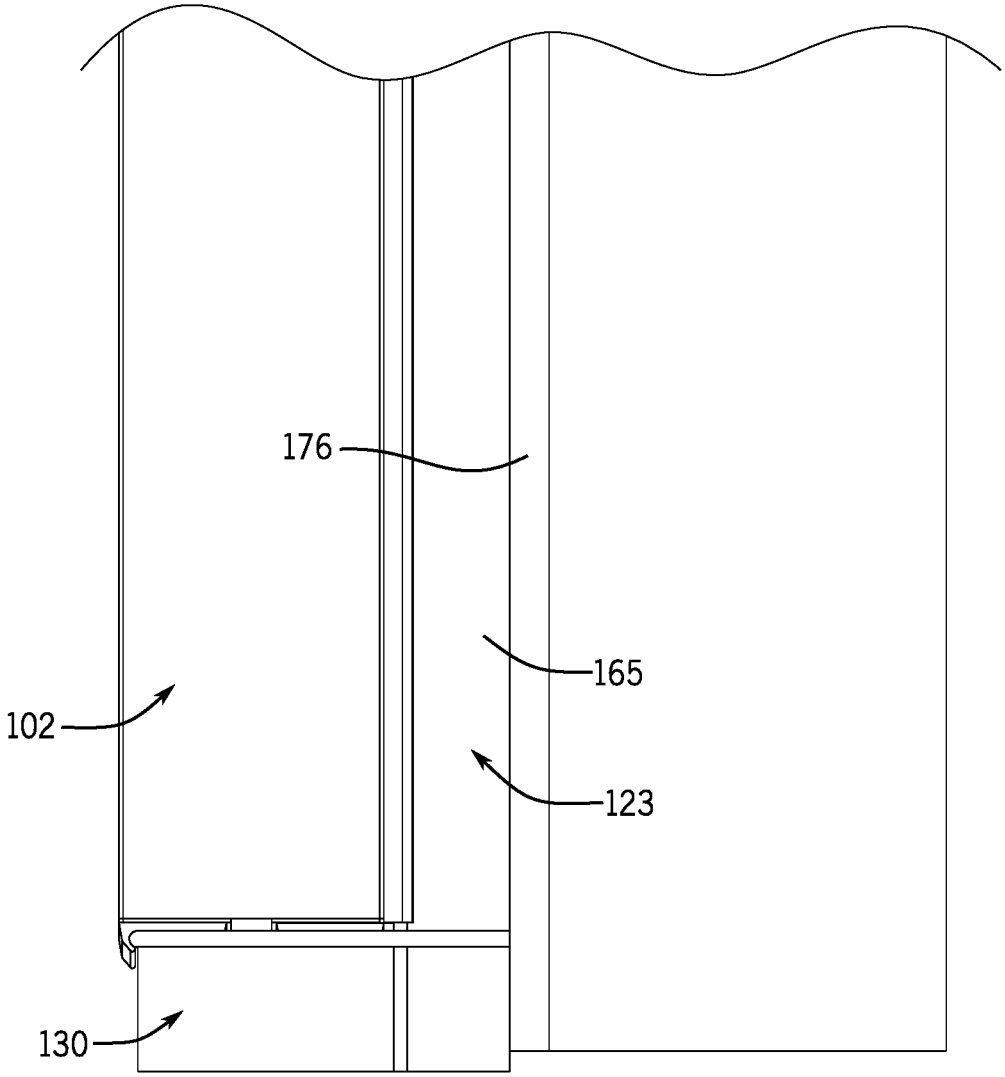
FIG. 13 is a detail view of a trailing end portion of a peripheral seal of the sealing system of FIG. 1, shown engaged with a vertical door frame member.

From the lower airflow pathway 168, the heated air can then flow into the peripheral airflow pathway 152 about the periphery of the sealing door 102. As shown in FIGS. 11-13, when the sealing door 102 is in the closed position, the leading end portion 163 (shown in FIG. 11) and the trailing end portion 165 (shown in FIG. 13) of the peripheral seal 123 engage vertical door frame members 176, and the upper portion 164 (shown in FIG. 12) engages a horizontal door frame member 178. The engagement (or close proximity) between the peripheral seal 123 and the various door frame members 176, 178 provides a seal for the peripheral airflow pathway 152, so that air flowing within the peripheral airflow pathway 152 does not excessively leak out into either of the freezer of the uncontrolled/alternatively conditioned environment surrounding the sealing system 100.

As such, during operation, the sealing system 100 provides a sealed threshold between a conditioned space (e.g., a freezer area) and an uncontrolled or alternatively conditioned environment, while allowing for conditioned air to be directed into and circulated within the pathways of the sealing door 102 when the sealing door 102 is closed, thereby preventing the buildup of frost on the sealing door 102 and nearby surfaces. When the conditioned air is heated, the temperature and surface moisture of the floor near the lower airflow pathway 168 can be influenced to reduce undesirable conditions, such as surface moisture and frost formation.

Figure 14:
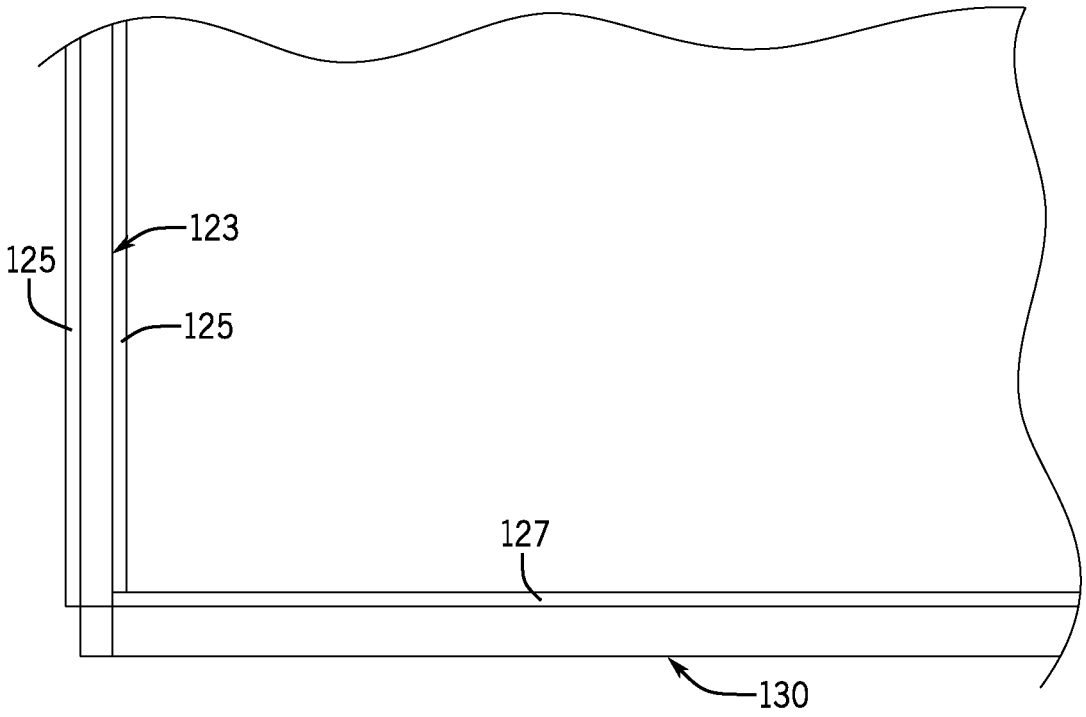
FIG. 14 is a detail view of a trailing lower corner of the sliding door of FIG. 4, shown with the sealing system alternatively coupled to the sliding door using a hook and loop fastener.
Figure 15:
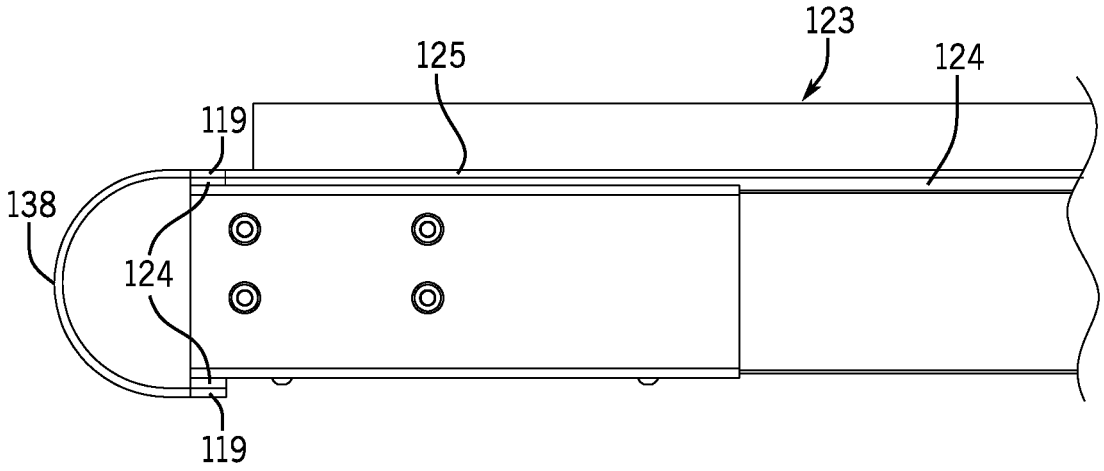
FIG. 15 is a detail view of a leading upper corner of the sliding door of FIG. 14.

FIGS. 14 and 15 show the lower seal 130, the peripheral seal 123, and the bumper portion 138 of the bumper seal 122 alternatively coupled to the sealing door 102 using a hook and loop fastener (e.g., Velcro). For example, referring to FIG. 14, the peripheral seal 123 includes flap portions 125 that run along the periphery of the sealing door 102. Similarly, the lower seal 130 includes a flap portion 127 running along the length of the lower end 136 of the sealing door 102. Each of the flap portions 127 are coupled to the sealing door 102 using a hook a loop fastener 124 (shown in FIG.

15). Referring to FIG. 15, the flap portions 119 of the bumper portion 138 alternatively extend beyond the leading end 132 of the sealing door 102. The flap portions 119 are similarly coupled to the sealing door 102 using a hook and loop fastener 124.

Figure 16:
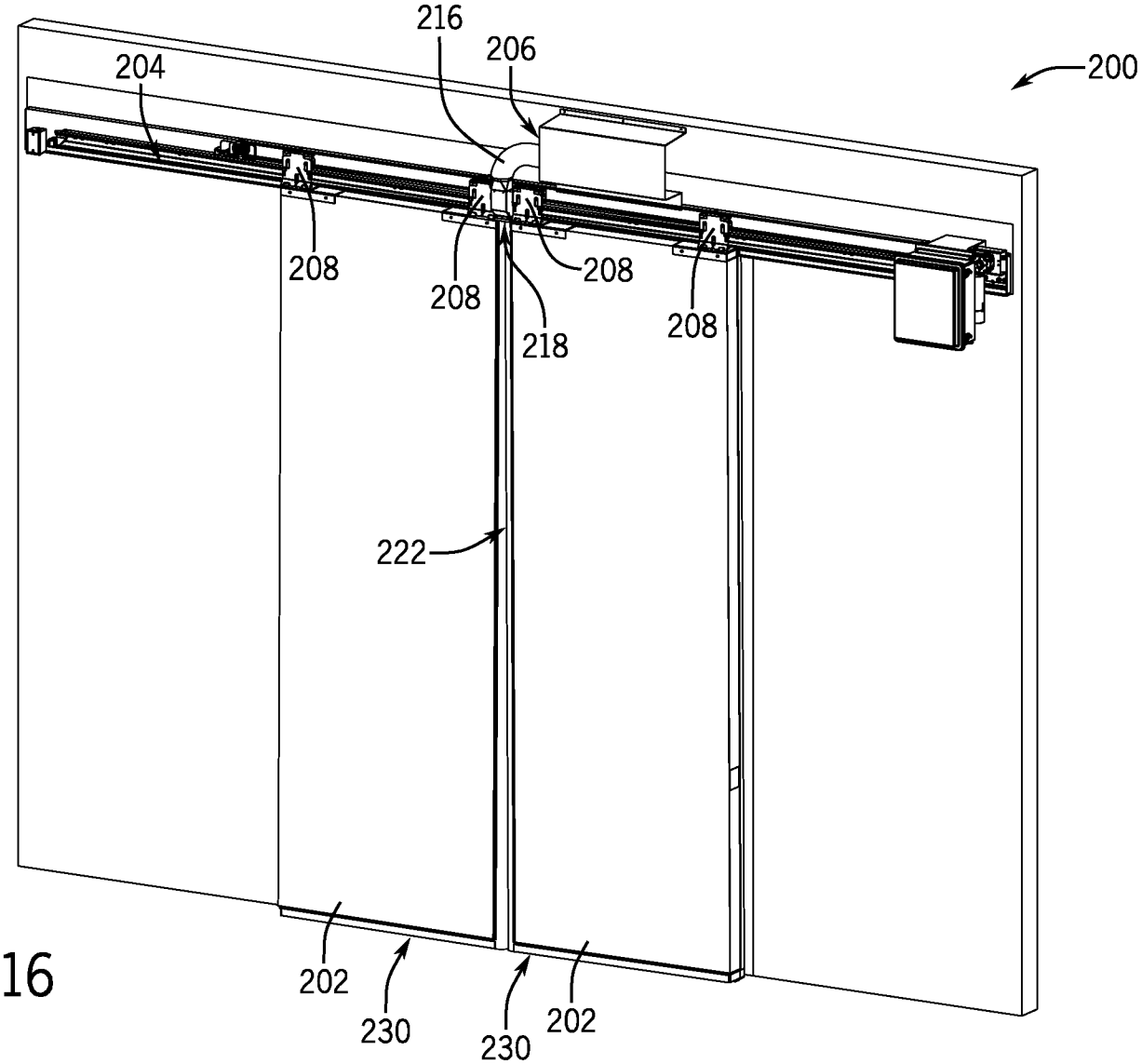
FIG. 16 is a front, top, right, isometric view of another example sealing system in accordance with the disclosure, shown in a closed position.
Figure 17:
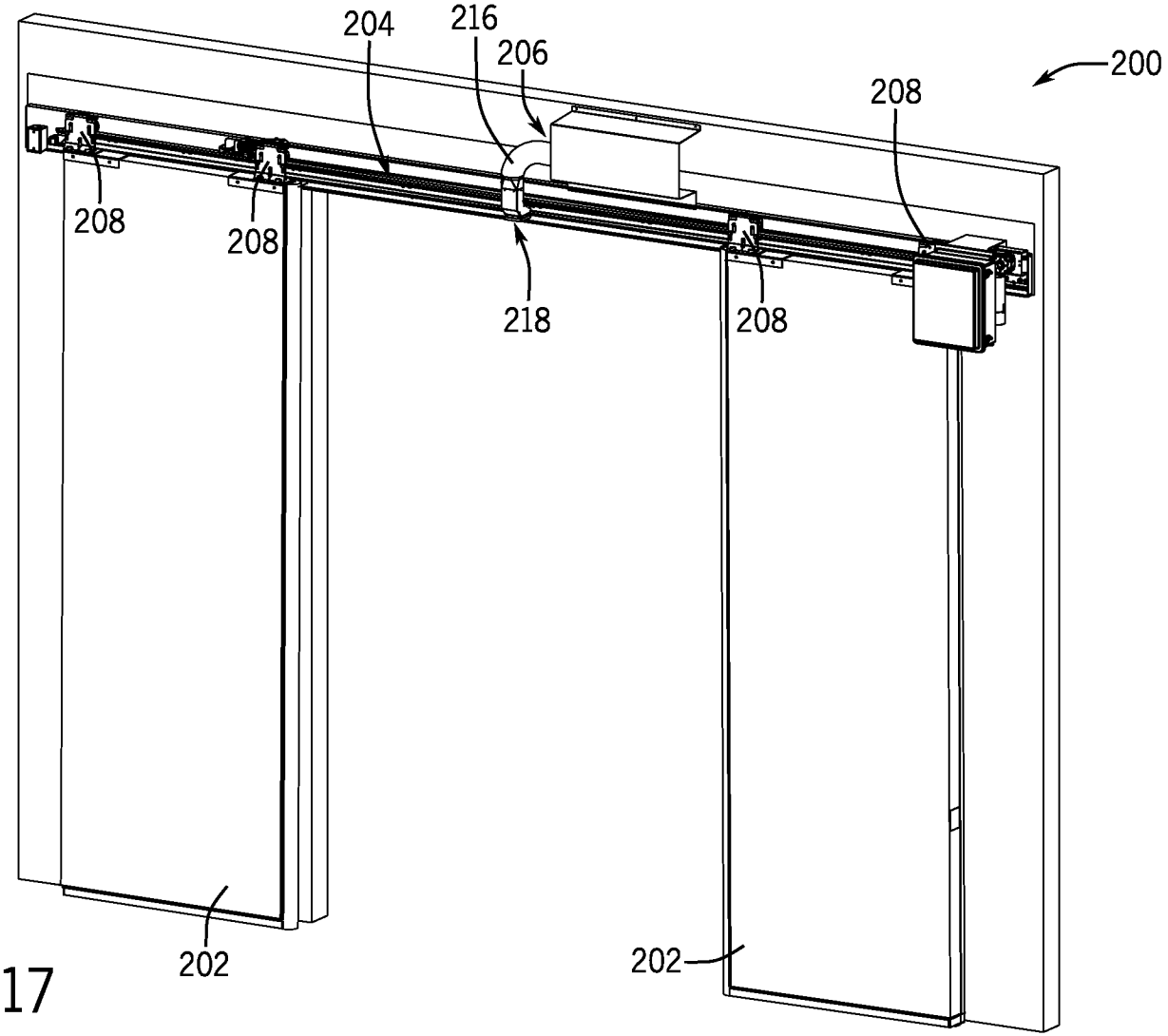
FIG. 17 is a front, top, right, isometric view of the sealing system of FIG. 16, shown in an opened position.

FIGS. 16 and 17 show another exemplary sealing system 200 in accordance with the disclosure. The sealing system 200 is similar to the sealing system 100, described above, and as such, like components will be labeled with like numerals in the 200 series (i.e., sealing door 102 and sealing doors 202, bumper seal 122 and bumper seals 222, etc.). As illustrated, the sealing system 200 comprises a pair of sealing doors 202, a sliding door track 204, and a heating device 206. The sealing doors 202 are slidably coupled to the sliding door track 204 by track-engaging roller carriages 208. The sealing doors 202 are movable between a closed position (shown in FIG. 16) and an opened position (shown in FIG. 17).

Figure 18:
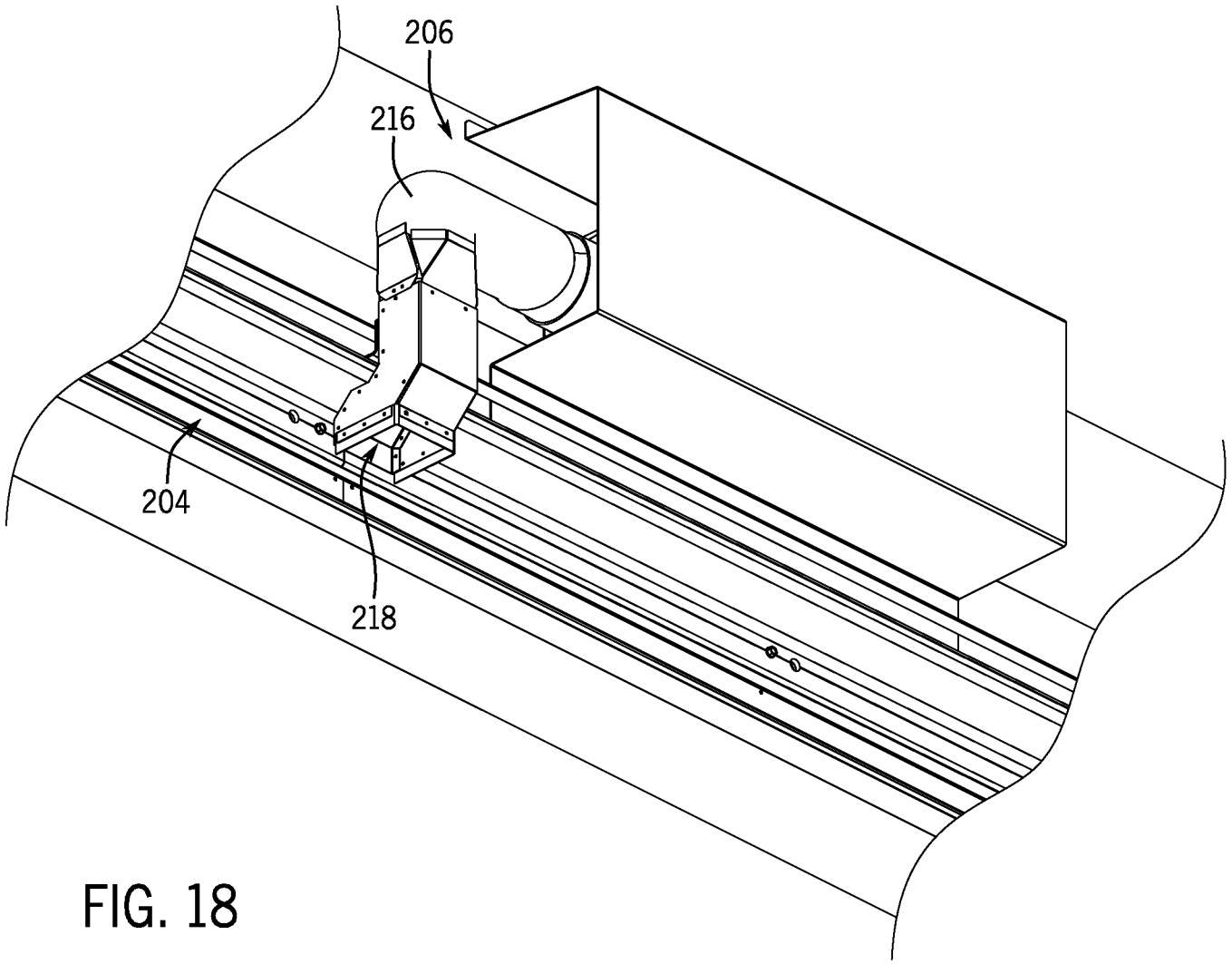
FIG. 18 is a front, bottom, left, perspective view of a heating device of the sealing system of FIG. 16.

The heating device 206 is disposed centrally on the sliding door track 204. The heating device 206 again includes a heating element (not shown), a fan motor (not shown), a fan conduit 216, and an outlet section 218. The fan motor is configured to blow air heated by the heating element, through the fan conduit 216, out of the outlet section 218. As shown in FIG. 18, the outlet section 218 is planar, so that the outlet section 218 is configured to sit flush with and directly above the bumper seals 222 (shown in FIG. 16) of the sealing doors 202 when the sealing doors 202 are closed.

Figure 19:
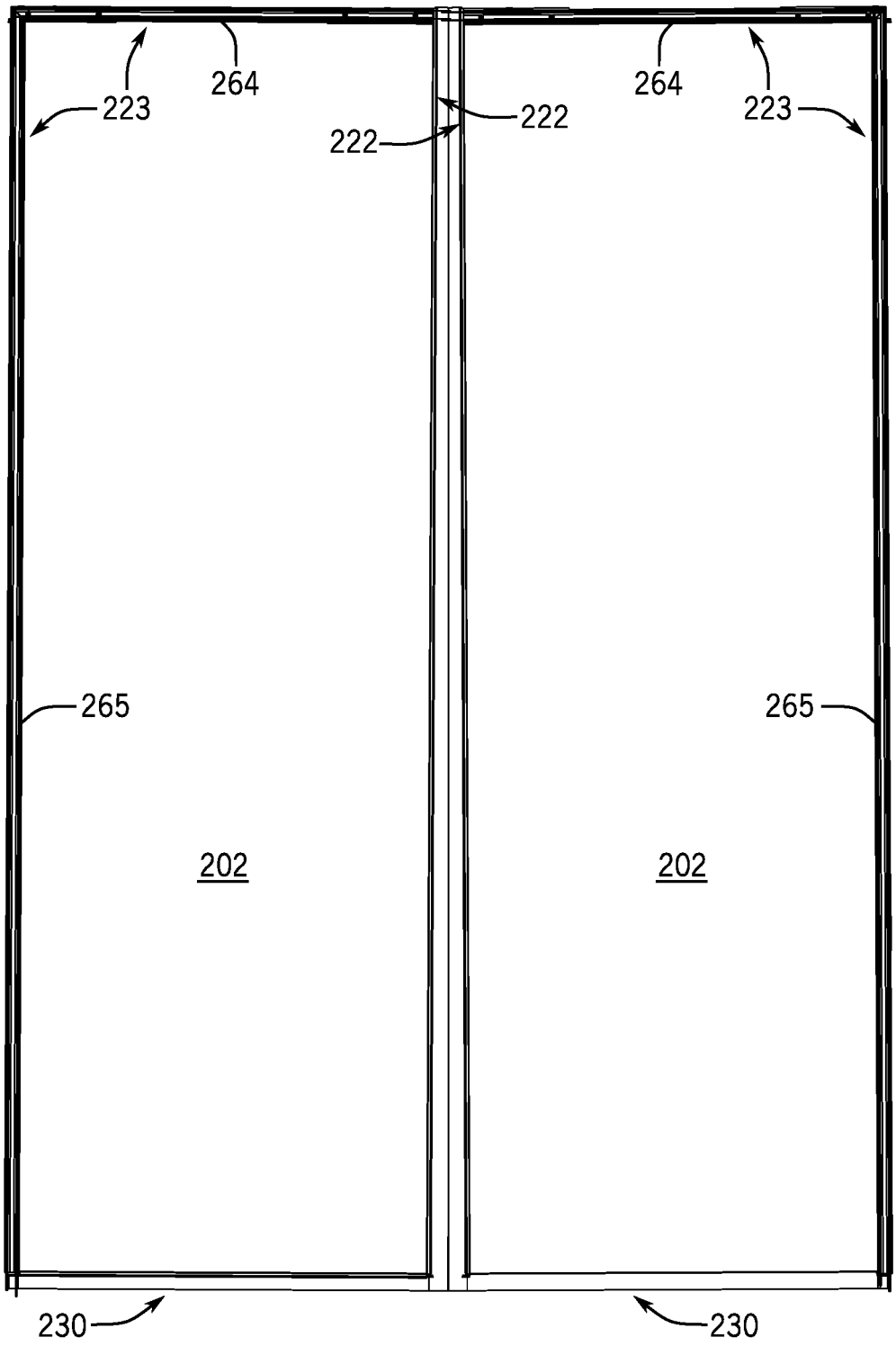
FIG. 19 is a rear elevational view of a pair of sliding doors of the sealing system of FIG. 16.
Figure 20:
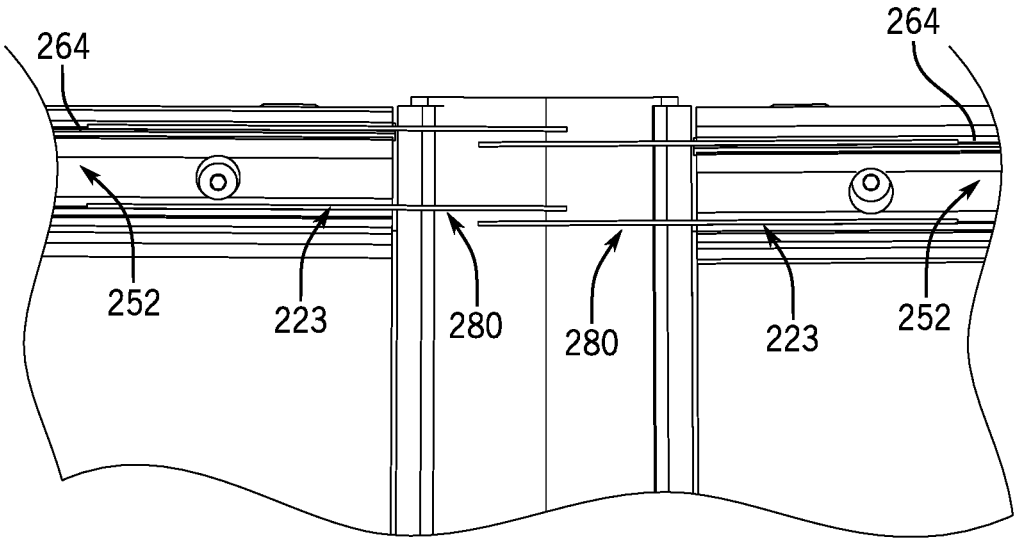
FIG. 20 is a detail view of meshing upper seals of the pair of sliding doors of FIG. 19.

Referring now to FIG. 19, each of the sealing doors 202 comprises the bumper seal 222, a peripheral seal 223, and a lower seal 230. The bumper seals 222 are substantially similar to the bumper seal 122. The peripheral seals 223, however, do not include leading end portions. As such, the peripheral seals 223 include a trailing end portion 265 and an upper portion 264. As shown in FIG. 20, the upper portions 264 of the peripheral seals 223 each include upper portion extensions 280 configured to mesh with each other, so that the peripheral airflow pathway 252 of the two peripheral seals 223 are in fluid communication with each other. Accordingly, the peripheral airflow pathway 252 extends between the sealing doors 202.

Figure 21:
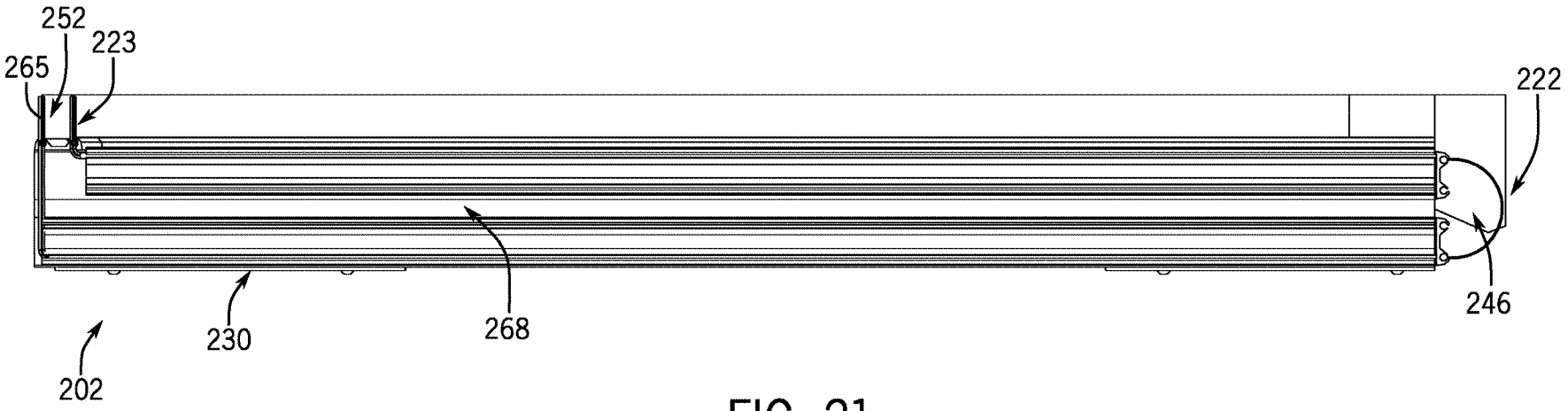
FIG. 21 is a bottom plan view of a sliding door of the pair of sliding doors of FIG. 19.

Referring now to FIG. 21, the lower seal 230 is substantially similar to the lower seal 130, except that it is only coupled to the bumper seal 222 and the trailing end portion 265 of the peripheral seal 223, as there is no leading end portion of the peripheral seal 223. As such, the bumper airflow pathway 246 of each sealing door 202 is in fluid communication with the corresponding lower airflow pathway 268, which is in fluid communication with the corresponding peripheral airflow pathway 252, which is further in fluid communication with the peripheral airflow pathway 252 of the peripheral seal 223 of the opposite sealing door 202.

Referring back to FIGS. 16 and 17, during operation, when the sealing doors 202 are in the closed position, the bumper seals 222 contact each other, creating a seal therebetween. Further, the outlet section 218 of the heating device 206 is aligned with and disposed directly above the contacting bumper seals 222, so that the heating device 206 directs heated air downward into each of the bumper airflow pathways 246. From the bumper airflow pathways 246, the heated air flows into each of the lower airflow pathways 268 of the lower seals 230. Again, the lower seals 230 engage or are near the floor during operation, thereby providing an efficient seal for the lower airflow pathways 268, so that air flowing within either of the lower airflow pathways 268 does not excessively leak out into either of the freezer (i.e., the conditioned space) or the uncontrolled/alternatively conditioned environment surrounding the sealing system 200. From the lower airflow pathways 268, the heated air then flows into the corresponding peripheral airflow pathways 252.

Figure 22:
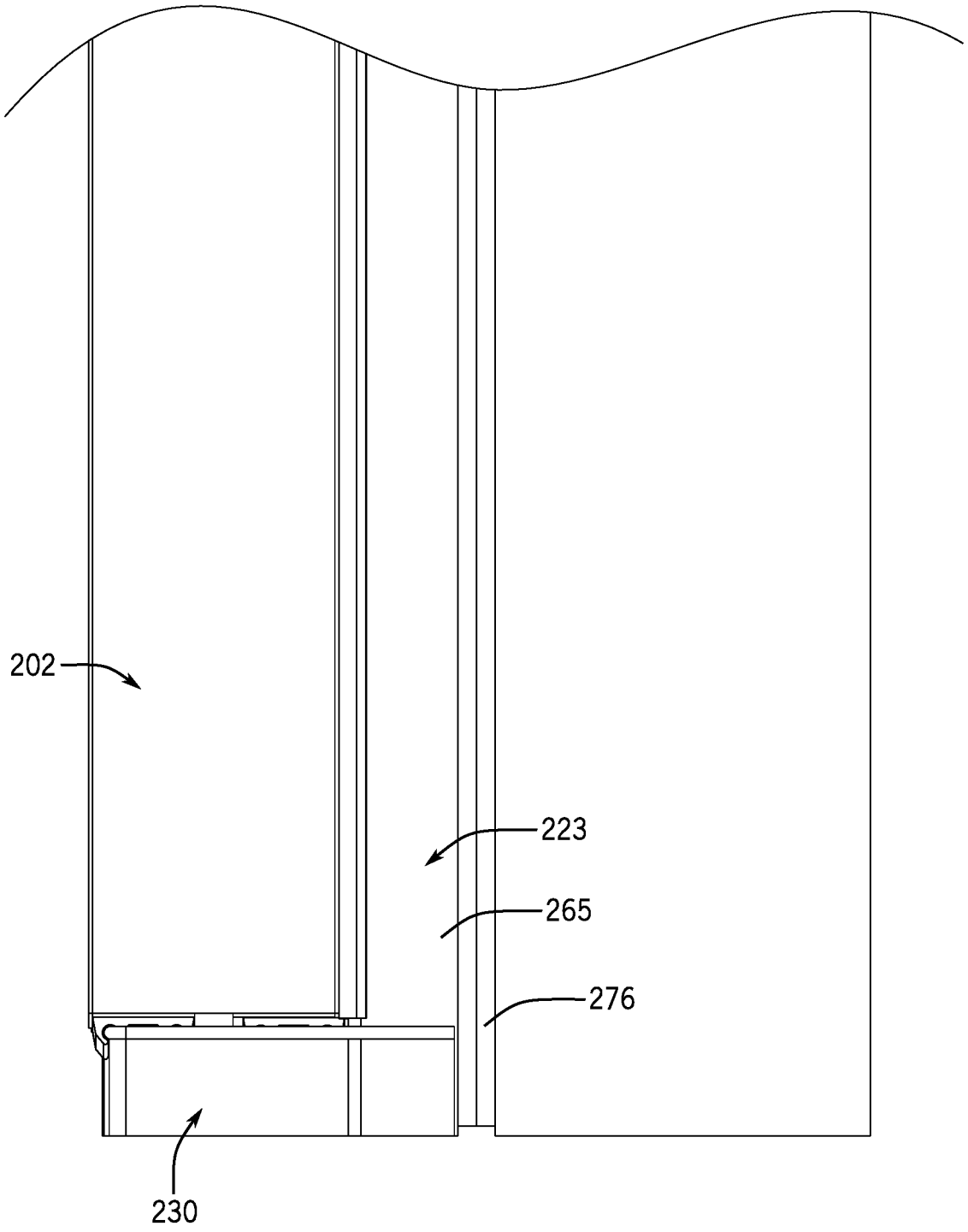
FIG. 22 is a detail view of a trailing portion of a peripheral seal of the sealing system of FIG. 16, shown engaged with a vertical door frame member.
Figure 23:
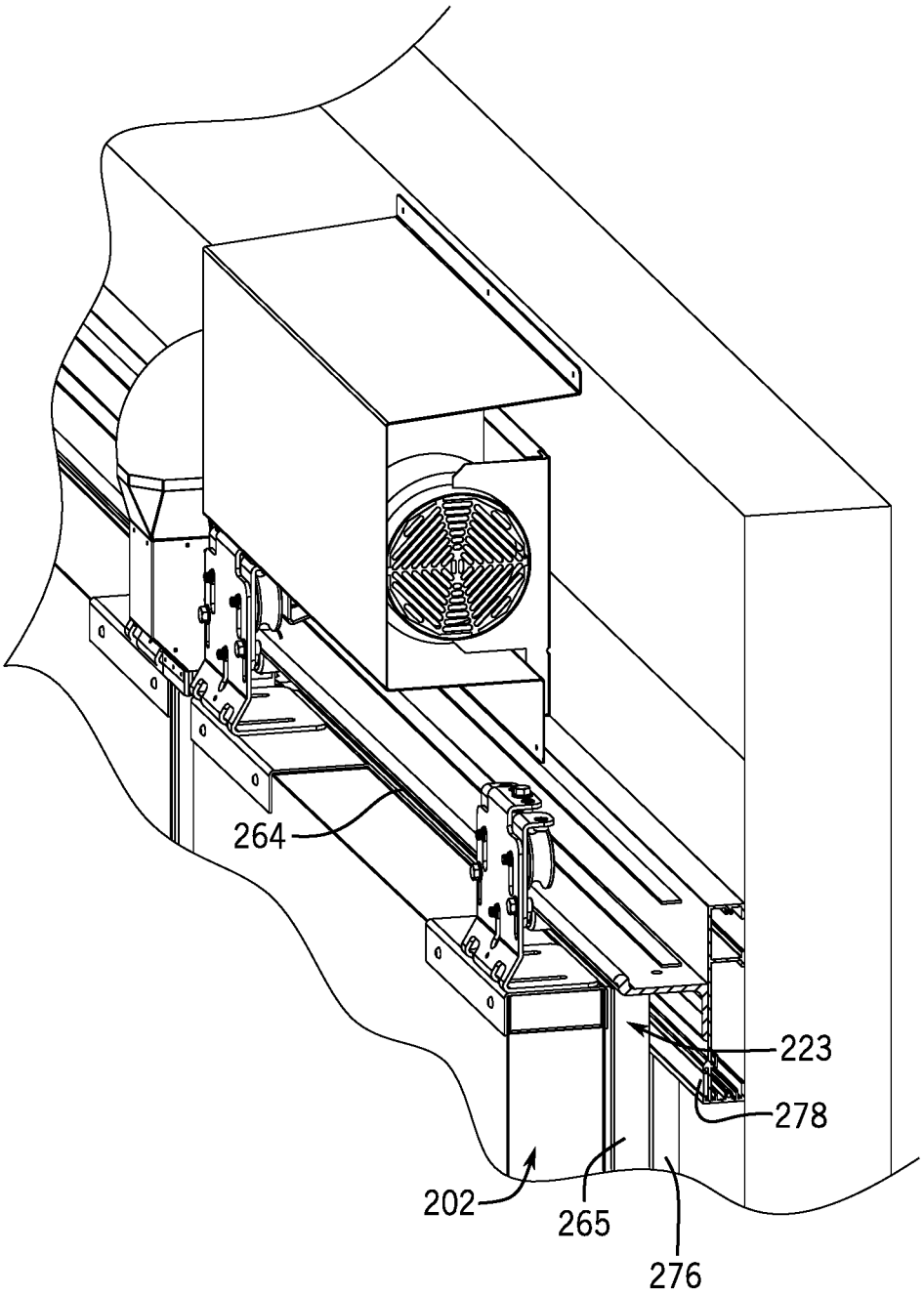
FIG. 23 is a detail view of an upper portion of a peripheral seal of the sealing system of FIG. 16, shown engaged with a horizontal door frame member.

As shown in FIGS. 22 and 23, when the sealing door 202 is in the closed position, the trailing end portions 265 of the peripheral seals 223 similarly engage vertical door frame members 276 (shown in FIG. 22), and the upper portions 264 similarly engage a horizontal door frame member 278 (shown in FIG. 23). The engagement between the peripheral seals 223 and the various door frame members 276, 278 again provides a seal for the peripheral airflow pathways 252, so that heated air flowing within the peripheral airflow pathways 252 does not excessively flow out of the pathways and into either of the freezer or the surrounding environment of the sealing system 200 at an undesired location. As such, the heated air can finally flow into the peripheral airflow pathway 252 of the opposing sealing door 202, thereby allowing for the heated air to be fluidly communicated through all of the various airflow pathways 246, 252, 268 of each sealing door 202 and directed toward the floor.

As such, during operation, the sealing system 200 provides a sealed threshold between a conditioned space and an alternatively conditioned environment, while allowing for heated air to be directed about and around the sealing door 202 when the sealing door 202 is closed, thereby preventing the buildup of frost on the sealing door 202. In addition, the sealing system 200 establishes a conduit to direct conditioned air to ultimately influence the properties of the threshold beneath the door, such as the floor temperature and surface moisture, which can reduce the presence and impact of undesirable conditions along the floor.

It will be appreciated by those skilled in the art that while the invention has been described above in connection with particular embodiments and examples, the invention is not necessarily so limited, and that numerous other embodiments, examples, uses, modifications, and departures from the embodiments, examples, and uses are intended to be encompassed by the claims attached hereto. The entire disclosure of each patent and publication cited herein is incorporated by reference, as if each such patent or publication were individually incorporated by reference herein.

Various features and advantages of the invention are set forth in the following claims.

The invention claimed is:

1. A sealing system configured to provide a sealed boundary between a first environment and a second environment, the sealing system comprising:

at least one door moveable between an opened position and a closed position, the at least one door defining a leading end, a trailing end opposite the leading end, an upper end, a lower end opposite the upper end, an outer door surface, and an inner door surface spaced from the outer door surface;

a conditioning device configured to direct conditioned air through an outlet; and a seal assembly coupled to the at least one door, the seal assembly including a bumper seal coupled to the leading end and defining a bumper airflow path and a lower seal coupled to the lower end and defining a lower airflow path that is in fluid communication with the bumper airflow path;

wherein, when the at least one door is in the closed position, the outlet of the conditioning device is aligned with the bumper seal and is configured to direct conditioned air through the bumper airflow path, thereby urging conditioned air through the bumper airflow path into the lower airflow path; and wherein, when the at least one door is in the opened position, the outlet of the conditioning device is not aligned with the bumper seal.

2. The sealing system of claim 1, wherein:

the seal assembly further includes a peripheral seal coupled to the inner door surface and defining a peripheral airflow path that is in fluid communication with the lower airflow path; and wherein, when the at least one door is in the closed position, the outlet of the conditioning device is aligned with the bumper seal and is configured to direct conditioned air through the bumper airflow path, thereby urging conditioned air from the lower airflow path into the peripheral airflow path.

3. The sealing system of claim 2, wherein the lower seal and the peripheral seal each comprise a pair of blade seals that are spaced apart.

4. The sealing system of claim 3, wherein each of the blade seals comprises a blade portion and an end seam.

5. The sealing system of claim 4, wherein the end seam of each of the blade seals is slidably received within a seam channel disposed on a channel member that is coupled to the at least one door, thereby coupling each of the blade seals to the at least one door.

6. The sealing system of claim 5, wherein each of the channel members are adhered to the at least one door.

7. The sealing system of claim 2, wherein:

the at least one door comprises another door;

the seal assembly includes another seal assembly on the another door, the another seal assembly includes another peripheral seal defining another peripheral seal airflow path; and the peripheral airflow path of the at least one door and the another peripheral seal of the another door are in fluid communication with each other when the at least one door is in the closed position and adjacent to the another door.

8. A sealing system configured to provide a sealed boundary between a first environment and a second environment, the sealing system comprising:

a pair of doors being moveable between an opened position and a closed position, each door of the pair of doors having a seal assembly coupled thereto and defining an airflow path with an inlet proximate an upper end of each door of the pair of doors;

a conditioning device configured to direct conditioned air through an outlet that is separate from each of the seal assemblies;

wherein, when the pair of doors is in the closed position, the outlet of the conditioning device is aligned with the inlet of each of the seal assemblies on each of the pair of doors and is configured to direct conditioned air through the airflow paths of the pair of doors, thereby urging conditioned air through the airflow paths; and wherein, when the pair of doors is in the opened position, the outlet of the conditioning device is not aligned with the inlet of either of the seal assemblies on the pair or doors.

9. The sealing system of claim 8, wherein, when the pair of doors is in the closed position, the airflow paths are in fluid communication with each other.

10. The sealing system of claim 8, wherein each of the seal assemblies includes a bumper seal, a lower seal, and a peripheral seal.

11. The sealing system of claim 10, wherein the bumper seal includes a bumper airflow path, the lower seal includes a lower airflow path, and the peripheral seal includes a peripheral airflow path.

12. The sealing system of claim 11, wherein the bumper airflow path, the lower airflow path, and the peripheral airflow path are all in fluid communication with each other.

13. The sealing system of claim 10, wherein the lower seal and the peripheral seal each comprise a pair of blade seals that are spaced apart.

14. The sealing system of claim 8, wherein each of the seal assemblies are coupled to a corresponding one of the pair of doors by a hook and loop fastener.

15. A seal assembly configured for use with a door having a leading end, an upper end, a trailing end, a lower end, and an inner door surface, the seal assembly comprising:

a bumper seal configured to couple to and extend along the leading end of the door and defining a bumper airflow path;

a lower seal configured to couple to and extend along the lower end of the door and defining a lower airflow path; and a peripheral seal configured to couple to the inner door surface of the door and extend along each of the leading end, the upper end, and the trailing end of the door, and defining a peripheral airflow path, wherein the bumper seal, the lower seal, and the peripheral seal are configured to collectively form an airflow path when coupled to the door; and wherein the airflow path extends from the bumper airflow path, through the lower airflow path, and to the peripheral airflow path.

16. The sealing system of claim 15, wherein the lower seal and the peripheral seal each comprise a pair of blade seals that are spaced apart.

17. The sealing system of claim 15, further comprising:

a bumper seal channel member coupled to the bumper seal and configured to couple to and extend along the leading end of the door;

a lower seal channel member coupled to the lower seal and configured to couple to and extend along the lower end of the door; and a plurality of peripheral seal channel members coupled to the peripheral seal and configured to couple to the inner door surface of the door and extend along each of the leading end, the upper end, and the trailing end of the door.

18. The sealing system of claim 17, wherein each of the blade seals comprises a blade portion and an end seam, and the end seam of each of the blade seals is slidably received within a seam channel disposed on the corresponding lower seal channel member or peripheral seal channel member.

* * * * *